United States Patent [19]

Schippers et al.

[11] 4,223,849

[45] Sep. 23, 1980

[54] CHUCKING SPINDLE FOR THE RECEPTION OF A BOBBIN CARRIER

[75] Inventors: Heinz Schippers; Erich Lenk, both of Remscheid, Fed. Rep. of Germany

[73] Assignee: Barmag Barmer Maschinenfabrik Aktiengesellschaft, Remscheid-Lennep, Fed. Rep. of Germany

[21] Appl. No.: 61,747

[22] Filed: Jul. 30, 1979

Related U.S. Application Data

[63] Continuation-in-part of Ser. No. 902,386, May 3, 1978, Pat. No. 4,175,712.

[30] Foreign Application Priority Data

| | | | |
|---|---|---|---|
| May 4, 1977 | [DE] | Fed. Rep. of Germany | 2719853 |
| Apr. 17, 1978 | [CH] | Switzerland | 4087/78 |
| Dec. 18, 1978 | [DE] | Fed. Rep. of Germany | 2854715 |

[51] Int. Cl.[3] ..... B65H 54/54; B65H 54/74

[52] U.S. Cl. ..... 242/46.4

[58] Field of Search ..... 242/46.4, 46.2, 46.3, 242/46.5, 46.6, 72 R, 72 B, 72.1, 68.1, 68.2, 68.3; 279/2 R, 2 A, 4

[56] References Cited

U.S. PATENT DOCUMENTS

| | | | |
|---|---|---|---|
| 683,865 | 10/1901 | Skofsrud | 242/72 R |
| 2,192,358 | 3/1940 | Lieber | 242/72 R |
| 2,682,924 | 7/1954 | Lomazzo et al. | 242/72 R X |
| 2,734,691 | 2/1956 | Godat | 242/72 R |
| 2,922,592 | 1/1960 | Kaltenbach | 242/72 R X |
| 3,550,873 | 12/1970 | Walker | 242/72 R |
| 3,815,836 | 6/1974 | Munnekehoff et al. | 242/46.4 |
| 3,833,179 | 9/1974 | Maurer | 242/46.4 |

FOREIGN PATENT DOCUMENTS

| | | | |
|---|---|---|---|
| 1262718 | 3/1968 | Fed. Rep. of Germany | 242/46.4 |
| 1003920 | 9/1965 | United Kingdom | 242/46.4 |

*Primary Examiner*—Stanley N. Gilreath
*Attorney, Agent, or Firm*—John H. Shurtleff

[57] ABSTRACT

An improved clamping chuck for use in a thread winding device wherein a bobbin carrier is removably mounted and held on an expandable chucking spindle by means of swingable, elongated clamping elements which are distributed about the outer circumferential mantle of the chucking spindle and move radially outwardly and inwardly of the mantle surface through openings defining each clamping position. The improvement comprises a combination of these special clamping elements with means to apply two torque-producing forces causing each clamping element to swing into its clamping position outwardly of the mantle, preferably under a spring tensioned force, and another force transmitting means to counteract the torque-producing forces to return the clamping elements into their retracted or release position below the mantle surface in order to change bobbin carriers. In the preferred embodiment, the counteracting force transmitting means is a compressed air operated annular piston ring which is slidably mounted about the chuck in an annular interspace between the spindle and a mantle sleeve so as to engage the clamping elements which are mounted in common cages formed in the annular interspace, using a self-contained arrangement within the spindle for delivering the compressed air to the cylinder operating the piston ring.

22 Claims, 6 Drawing Figures

CHUCKING SPINDLE FOR THE RECEPTION OF A BOBBIN CARRIER

This application is a continuation-in-part of our prior copending application, Ser. No. 902,386, filed May 3, 1978, now U.S. Pat. No. 4,175,712, the subject matter of which is incorporated herein by reference as fully as if set forth in its entirety.

BACKGROUND OF THE INVENTION

The present invention relates generally to a chucking spindle arrangement for use in a thread winding device where threads, yarns, filaments or the like are wound onto a bobbin carrier or core sleeve. In particular, the present invention relates to an improved chucking spindle which forms a part of the winding shaft on such a device and which is expandable in order to secure the bobbin carrier thereto.

A number of different chucking spindle constructions are known for securely locking bobbin carriers onto the carrying arm or winding shaft of thread winding machines. For example, so-called bar tension chucks have a wide enlargement or an axially slidable cone mounted on the chucking shaft which cooperates with respect to a counter-cone arrangement. In securing the bobbin carrier to the chucking device, the counter-cone is moved radially outward by shifting the axially slidable cone thereby gripping the bobbin carrier thereabout.

However, such cone-type chucking spindles have the disadvantage that a slide fit is required between the chuck shaft and the cone. This slide fit is of a very complicated design since otherwise, after a relatively short operational period, jamming and rusting inside the slide fit would occur, thereby taking the entire chucking spindle out of operation.

In order to overcome these drawbacks found with cone-type chucking spindles, clamping elements that operate according to the so-called "freewheeling" or coasting principle were developed. An example of such a chucking spindle is disclosed in U.S. Pat. No. 3,815,836 to Munnekehoff et al. Such chucking spindles are especially advantageous in that the clamping elements thereof are self-locking so that even with the introduction of high torsional or braking forces the bobbins will remain securely clamped.

However, in spite of the mechanical advantages of such "freewheeling" chucking spindles, several operational difficulties have been encountered in their use. Since the mounting and removal of the bobbin carriers takes place by means of turning them by hand in order to disengage the clamping elements of the device while simultaneously moving the carriers axially on or off of the chucking shaft, if several bobbin carriers are arranged in axial succession on a single chucking spindle, the rearmost bobbin carrier must be slid over all of the front clamping zones in order to mount or remove it. Hence, with great care the bobbin carrier must be constantly rotated by hand from the front to back of the chuck shaft as it is slid thereon and this process must be again repeated when it is removed.

The chucking spindle of the present invention was developed in part to take advantage of the desirable self-locking features of the known "freewheeling" spindles, while at the same time avoiding all of the above-described disadvantages of conventional chucking spindles. The present invention also led to a number of special clamping elements which can be automatically disengaged or released from the bobbin carriers.

BRIEF DESCRIPTION OF THE INVENTION

The present invention eliminates the disadvantages found with conventional chucking spindle arrangements by providing an actuating means for moving the clamping elements mounted on the chucking spindle into their retracted position when it is desired to change the bobbin carrier. Since this actuating means is formed as a part of the chucking spindle, no external aids are needed to slide the bobbin carrier on or off of the device and it is immaterial whether such sliding of the bobbin carrier is carried out manually or by machine. Furthermore, since the working elements of the actuating means are integrated as a part of the rotating chucking spindle, no imbalance problems can arise during and after operation of the device.

The arrangement of the present invention may also be conveniently adapted for use with chucking spindles with clamping elements that operate according to the "freewheeling" or self-locking principle. Such an embodiment is especially desirable in that while all of the advantages of the "freewheeling" principle are utilized, it is avoided that the time-consuming and impractical steady rotary and axial movement of the bobbin carrier about the chucking spindle must be accomplished in order to remove or slide on the bobbin carrier, particularly where several bobbin carriers are used on one long chucking spindle. As has been noted, since the clamping force of these elements is unaffected by the present invention, their desirable independent operation according to the "freewheeling" principle is fully preserved.

If it is not desired to construct the chucking spindle according to the "freewheeling" principle, the present invention offers other types of improved chucking spindles. For example, kidney-shaped clamping elements which are very simple to produce may be used. The clamping force exerted by such elements may be made dependent upon a spring force that will allow automatic adjustment for different forms and sizes of the bobbin carrier.

A lug formed on the arcuate slide surface of the clamping elements engages the actuating means and also serves as a stop both in the extended direction of the elements when no bobbin carrier is placed about the chucking spindle and in the fully retracted position of the clamping elements. Hence, in this simple manner the functioning of the clamping elements is always assured.

Since in all embodiments the clamping elements immediately abut the chucking spindle, it may be formed entirely in a cylindrical shape. Furthermore, in contrast to bar tension-type chucks, fewer elements are moved during the tensioning and releasing of the clamping elements, thereby making the production of such chucking spindles more economical and their security in operation greater.

A substantial facilitation in the assembling and a further increase in the functional security of the device is provided by arranging the clamping elements of the chucking spindle in a common cage. In this manner, it is assured that all of the clamping elements of a clamping place are operated simultaneously and uniformly, thereby achieving a coaxial relationship between the bobbin carrier and chucking spindle.

By providing a winding groove which cooperates with the actuating means, the thrust component of the actuating means which is axially parallel to the axis of the chucking spindle may be transformed into a rotary movement with respect to said cage. This construction has the advantage that only one translational movement is performed by the actuating means and the necessary rotary movement is achieved through the unique construction of the actuating means itself.

It has been found that connecting the cage elements to the actuating means, which may be an annular piston ring slidably mounted about the chucking spindle, by means of axially parallel guide elements are forming the winding groove in the inner circumference of the piston ring for cooperation with a guide ball fixed to the outer circumference of the chucking spindle has proven to be successful as a manufacturing technique for transforming the axial movement of the piston ring into a rotary movement of the clamping elements.

The actuating means may be operated electrically, hydraulically, pneumatically or by similar suitable drive techniques. In the preferred embodiments discussed below, a pneumatically operated actuating means is utilized. In order to simplify the construction of the device, a torsion spring may be utilized to create a force which normally brings the clamping elements into their extended position. Hence, it is necessary that the actuating means exert thrust in only one direction of travel in order to bring the clamping elements into their released position.

A unique means is also presented for sealing the ends of the compressed air-carrying annular gap between the chucking spindle and carrying arm. In a preferred embodiment, this sealing means consists of an annular piston ring mounted for axial movement in the machine frame which is actuated by the compressed air supply prior to the air being supplied to the actuating means for the clamping elements. This arrangement has the advantage that no wear of the sealing elements is experienced during operation of the thread winding machine since it is only engaged when the bobbin carrier and chucking spindle are at a standstill.

A choke may be placed in the compressed air feed line in order to create a time lag in the air pressure build up between the resulting subdivisions of the line. In this manner, the sealing elements may be operated first before air is supplied to the actuating means for the clamping elements. Hence, no air leakage will occur so that all of the clamping elements of the chucking spindle will operate simultaneously.

As a final point, in order to prevent the bearings which support the chucking spindle upon the carrying arm from having their lubricant forced out when compressed air is introduced to release the clamping elements, the air is simultaneously supplied at substantially equal pressure from both sides of the bearings. Hence, the compressed air does not flow through the bearings in order to reach the individual actuating means for the clamping elements and no lubricant is thereby dragged away. In addition, no special sealing of the bearings from the compressed air is necessary.

DESCRIPTION OF THE PREFERRED EMBODIMENTS

Figure 1:
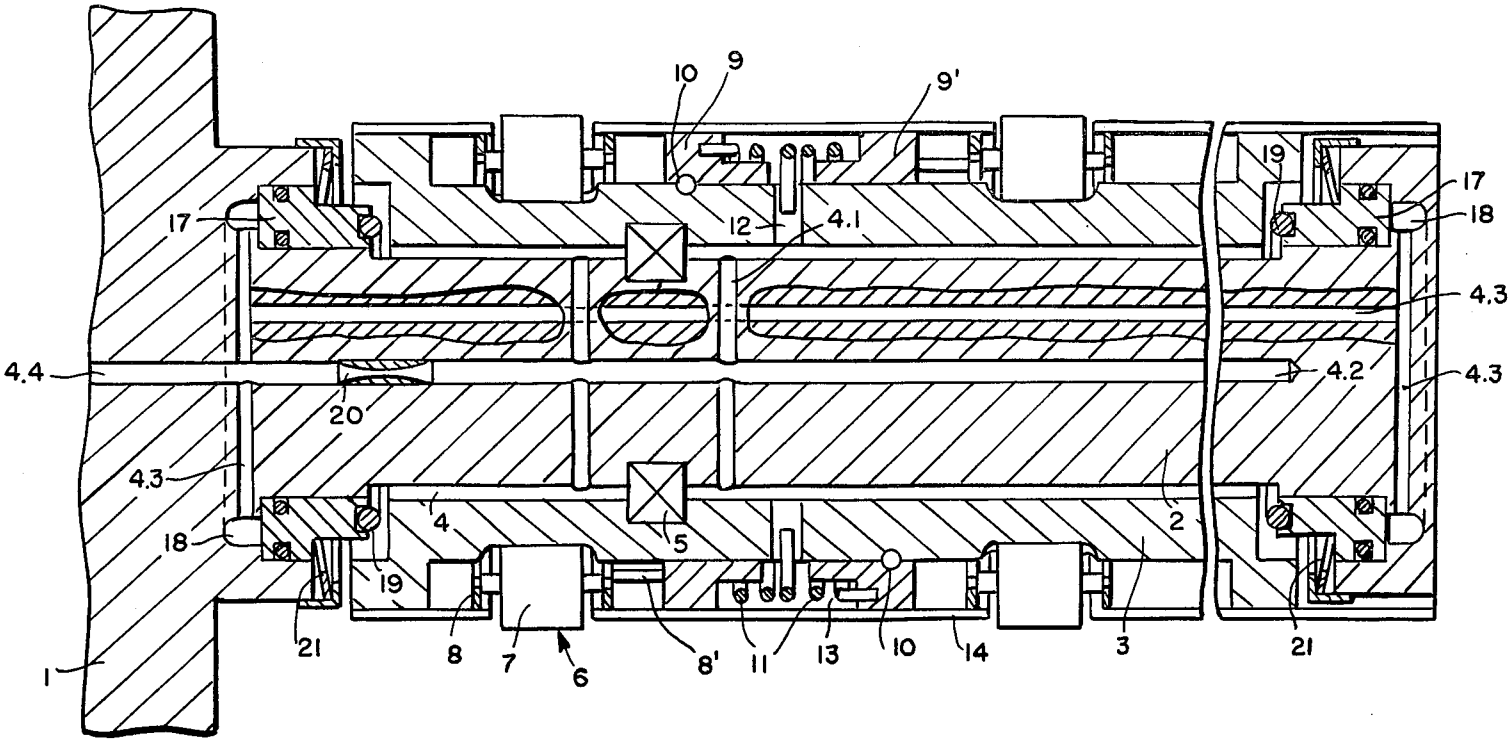
FIG. 1 is a schematic view in axial cross-section of a chucking spindle arrangement illustrating a particular embodiment of the present invention.

FIG. 1 illustrates a schematic view through the axis of a chucking spindle arrangement constructed in accordance with an embodiment of the present invention in which only the machine side and the front ends of the device are presented.

Secured to machine frame 1 is a carrying arm 2 which extends outwardly therefrom. Chucking spindle 3 is turnably fastened about arm 2 by means of bearing bodies 5.

Figure 3:
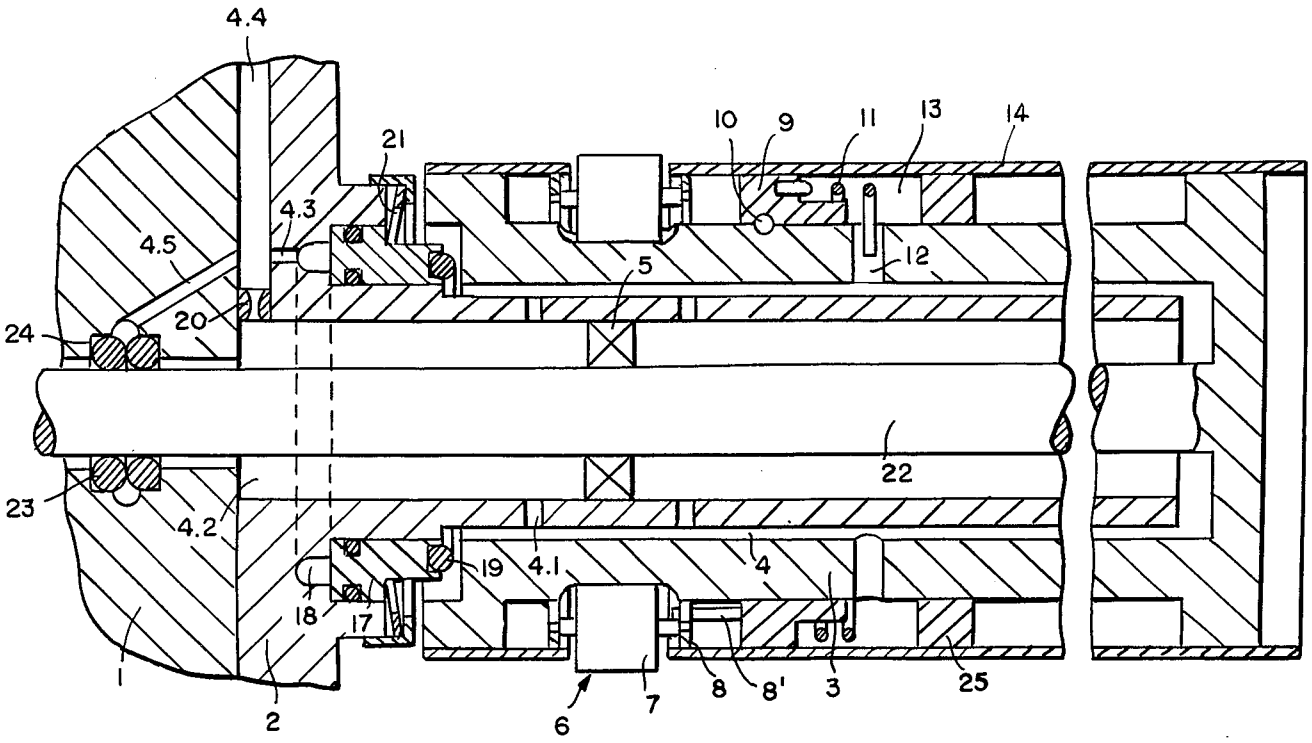
FIG. 3 is a schematic view in axial cross-section of an alternate embodiment of the chucking spindle arrangement shown in FIG. 1.

It should be noted that the chucking spindle 3 shown in this particular embodiment is not directly driven itself. Rather, an external drive or contact roller (not shown) engages the circumference of a bobbin or bobbin carrier (also not shown) which is secured to the chucking spindle. However, as is illustrated in FIG. 3, it is also possible for the chucking spindle itself to be directly driven by an appropriate internal drive means.

Between carrying arm 2 and chucking spindle 3 there is formed an annular gap 4 which extends over substantially the entire length therebetween. Radially arranged connecting channels 4.1 connect annular gap 4 with distributor channel 4.2. In a further preferred development of the present invention, connecting channels 4.1 are arranged on either side of bearing bodies 5 in order to insure that the lubricant contained in these bearings will not be forced therefrom by a one-sided or uneven air flow being created in annular gap 4.

At several axially separated locations about the circumference of chucking spindle 3, there are arranged clamping places 6. Since it is at these clamping places that the bobbin carrier or carriers (not shown) utilized with the spindle arrangement are engaged, their number and location will be determined by the number of bobbin carriers used.

Clamping places 6 consist of cylindrical rolls 7 which are held in a cage 8 which allows the radial play of the rolls therein. In this connection, the circumference of chucking spindle 3 is formed in a sawtooth manner in the region of clamping places 6 so that the clamping operation can operate according to the "freewheeling" principle. That is, by rotating cage 8 through a certain angular range, rolls 7 are moved outwardly along a bevel so that they achieve a greater radius with respect to the axis of the chucking spindle, thereby clamping the bobbin carrier in place. Likewise, by turning cage 8 in the opposite direction, rolls 7 will move inwardly along the bevel so that they will lie on a smaller radius, thereby releasing the bobbin carrier. This so-called "freewheeling" principle is illustrated in detail in the above-mentioned U.S. Pat. No. 3,815,836, the disclosure of which is incorporated by reference herein.

Figure 2:
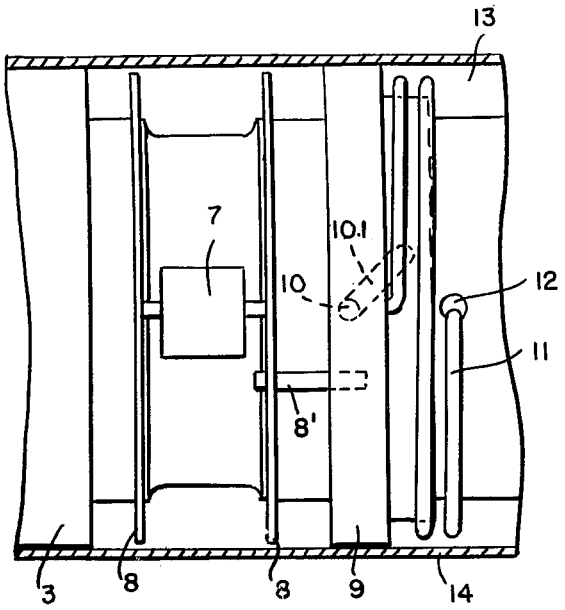
FIG. 2 is a top plan view of a portion of the apparatus shown in FIG. 1.

Referring now also to FIG. 2, on one side of cage 8 there is engaged by means of a linking pin 8′ a cylindrical, annularly formed piston 9. Piston 9 is guided by guide elements 10 within a winding groove 10.1 which is formed at an angle along the circumference of chucking spindle 3. By means of a torsion spring 11, the end of which is attached to annular piston 9, the elements contained in clamping place 6 are held in the clamping position. The inclination and angular direction of winding groove 10.1 is laid out in such a manner that the annular piston 9 operates the elements of clamping place 6 against the force of torsion spring 11 in its normal or released, non-clamping direction with respect to the bobbin carrier. The bore 12 into which the other end of torsion spring 11 is fastened to chucking spindle 3 serves also as the connecting channel between annular gap 4 and spring space 13.

Spring space 13, which in the sense of the present invention is utilized as a cylinder chamber for the drive of annular piston 9, is radially enclosed and sealed by mantle sleeve 14 which consists of individual sections whose total length corresponds to that of the chucking spindle 3. These individual sections of mantle sleeve 14 are formed such that rolls 7 can be turned unhampered between them. Spring space 13 is preferably bounded in the axial direction by a further annular piston 9′. If this arrangement cannot be achieved due to the distance between individual clamping places 6 being too great, a fixed ring 25 may be used to bound spring space 13 such as is shown in FIG. 3.

On the machine side and front end of chucking spindle 3, annular space 4 is bounded by further annular pistons 17 that are arranged for movement in machine frame 1 and the end of carrying arm 2 respectively. On the front end of each annular piston 17 is fitted an O-ring 19 which abuts against clamping mandrel 3. Annular cylinder spaces 18 are utilized to supply a pressure medium to power annular pistons 17. These cylinder spaces connect with bore 4.3 of central channel 4.4 for this purpose. Annular pistons 17 are held in their retracted starting position by means of plate springs 21. A choke 20 is utilized to divide feed channel 4.4 from distributor channel 4.2.

FIG. 2 illustrates a plan view of a portion of the chucking spindle 3 in which the outer mantle sleeve covering 14 has been removed in the vicinity of clamping places 6. In this cutaway view it is visible how annular piston 9 is guided by guide element 10 within winding groove 10.1 and how torsion spring 11 is arranged and secured thereto. As has been described above, roll 7 is turnably borne within cage 8 which is turned over an axially movable carry-along member by the action of annular piston 9.

The functioning of the device will now be explained by reference to FIGS. 1 and 2. By means of central channel 4.4, distributor channel 4.2 is connected to a pressure medium source such as an air compressor (not shown in detail). If a new bobbin carrier is to be slipped on chucking spindle 3 or a wound bobbin carrier is to be removed therefrom after winding, this operation can only take place with the clamping bobbin at a standstill. During the winding operation, clamping elements 6 are held in the engaged position due to the lagging of the chucking spindle 3 with respect to the bobbin carrier. Hence, only during the releasing or slipping on of a bobbin carrier is it necessary to apply the pressure medium.

In order to bring rolls 7 into the released position against the action of torsion spring 11 which normally holds them in the engaged position, compressed air or any other suitable pressure medium is conducted through feed channel 4.4. By reason of the operation of choke 20, pressure first builds up in cylinder spaces 18 at both ends of the chucking spindle. Hence, annular pistons 17 with their O-rings 19 will be extended to seal gap 4 between carrying arm 2 and chucking spindle 3 at each of its ends.

After this sealing operation, distributor channel 4.2 and connecting bores 4.1 will likewise build up air pressure therein. Since this air pressure builds up equally on both sides of bearings 5, it is insured that the lubrication will not be forced from within these bearings. Furthermore, it is possible to add lubricant to the compressed air utilized with this system thereby simultaneously lubricating these bearings. This type of lubrication is highly advantageous since the bobbin carrier will be changed before and after each winding operation.

At this point, the compressed air now present in gap 4 will pass through bores 12 into cylinder spaces 13, thereby moving and turning annular pistons 9 within winding grooves 10.1 by means of guide elements 10. In this manner, rolls 7 are moved counter to the force of torsion spring 11 in such a way that they roll down sawtooth offsets, thereby decreasing their outer diameter with respect to the axis of the chucking spindle and freeing the bobbin carrier.

As long as compressed air is applied to distributor channel 4.2, rolls 7 will be maintained in the released position. However, when a new bobbin carrier is slipped on chucking spindle 3, the compressed air feed is interrupted thereby returning rolls 7 to their clamping position. This occurs because annular pistons 17 will be retracted into their normal non-sealing position by the action of springs 21 so that annular space 4 will once again be open at its ends. Hence, the pressure built up in distributor channel 4.2, connecting bores 4.1 as well as cylinder spaces 13 will be relieved thereby allowing rolls 7 to be turned by torsion spring 11 back into their normal, clamping position.

Turning now to FIG. 3, there is schematically represented a chucking spindle that has a central drive mechanism. This central drive arrangement may be used either to drive the entire bobbin winding operation or only for the braking of the rotating chucking spindle. In the latter case, the chucking spindle will be driven by an external drive roller as has been explained in connection with the embodiment shown in FIG. 1.

By contrast with the chucking spindle shown in FIG. 1, in this embodiment the chucking spindle 3 is connected at its face side away from the machine frame 1 to the drive shaft 22 which is centrally arranged within carrying arm 2. In this manner, the front annular piston 17 may be eliminated and the bearings 5 will be arranged between the drive shaft 22 and carrying arm 2 within distributor channel 4.2.

Since it is necessary with this arrangement to seal the drive shaft 22 within the machine frame 1 upon the introduction of a pressure medium into distributor channel 4.2, sealing elements 23 consisting of two O-rings arranged in an annular groove 24 formed about drive shaft 22 are utilized for this purpose. Annular groove 24 is also connected by means of one or more bores 4.5 with feed channel 4.4.

An alternate arrangement of cylinder space 13 is also illustrated in the embodiment of FIG. 3. Since individual clamping places 6 are separated by great axial distances in this particular embodiment, the cylinder spaces 13 are no longer bounded in the axial direction by corresponding annular pistons. Rather, cylinder space 13 is bounded at one axial end by an annular piston 9 and at the other end by a sleeve 25 which is fixed to the chucking spindle 3. It is possible that one sleeve 25 bound two adjacent cylinder spaces, although it may be desirable for each individual cylinder space to be bounded by a sleeve of its own. The space remaining between two of such sleeves would then be unused.

The construction and function of the individual clamping places 6 shown in FIG. 3 are the same as described above in connection with FIGS. 1 and 2. If rolls 7 are to be rotated about chucking spindle 3 into the released position for the bobbin carrier, then annular space 4 and distributor channel 4.2 must be sealed at their ends. Due to the action of choke 20, the compressed air flowing into feed channel 4.4. passes first into bore 4.3 which connects with cylinder space 18 at the machine frame side of the chucking spindle and bore 4.5 which connects with the sealing elements 23 of drive shaft 22. In this manner, annular piston 17 having O-ring 19 fitted to its front side will seal off annular space 4 and the compressed air will deform sealing elements 23 about drive shaft 22 thereby closing the gap which normally exists therebetween. Due to the design of annular groove 24, it is not possible for sealing elements 23 to be deformed in a direction other than about drive shaft 22.

At this point, the compressed air will then pass through distributor channel 4.2, connecting channels 4.1, annular space 4 and bores 12 in order to build air pressure in cylinder spaces 13 which drives annular pistons 9. As was described in detail above, rolls 7 will be moved into their released position by reason of piston 9 rotating about winding groove 10.1 by means of guide element 10.

After the bobbin change is completed, rolls 7 are brought back into their clamping position by disconnecting the compressed air supply. Once this is done the deformaton of sealing elements 23 will be cancelled and piston 17 will be returned to its normal position by spring 21, thereby releasing the air pressure built up in cylinder spaces 13 and allowing torsion spring 11 to return rolls 7 back to their normal clamping position.

It should also be noted that spring 11 may be omitted in both the embodiments shown in FIGS. 1 and 3 if desired since the normal torque and centrifugal forces created when the rotation of the chucking spindle is begun will insure the secure clamping of the bobbin carrier by rolls 7 in operation. However, if no clamping elements are used which operate according to the "free-wheeling principle", then alternatively the embodiments described in FIGS. 4–6 may be advantageously utilized.

Figure 4:
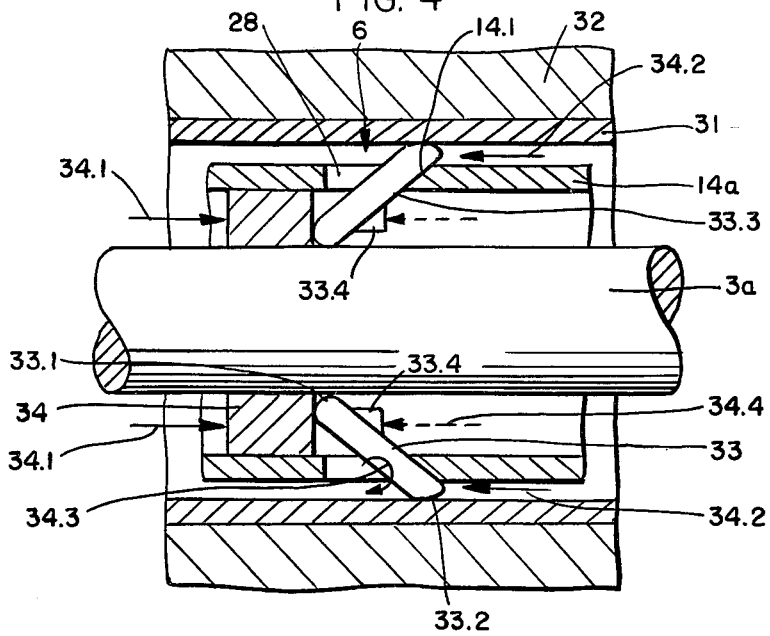
FIG. 4 is a schematic view in axial cross-section of another embodiment of a chucking spindle arrangement, taken through a partial segment of the spindle shaft with circumferential drive.

FIG. 4 illustrates only the center portion of the chucking spindle assembly in a schematic axial cross-section to offer another embodiment according to the invention using another kind of clamping means at positions generally identified by reference numeral 6. On a machine frame 1 as shown in FIG. 1, there is rotatably fastened about the projecting carrying arm 2 the particular chucking spindle 3*a* shown in FIG. 4. At several axially separated positions of the mantle sleeve 14*a* of the chucking spindle 3*a*, there are arranged the clamping positions 6 just as the prior embodiments so as to carry the spool or bobbin sleeve 31 on which the thread material 32 is spooled or wound.

The individual clamping positions 6 each consist essentially of a clamping element 33 having an elongated structure which at its pushing or thrust end 33.1 is supported on the spindle 3*a* and which at its other end, the clamping or gripping end 33.2, is radially passed through or positioned to move outwardly through an opening 28 in the mantle sleeve 14*a*. The mantle sleeve 14*a* has a larger diameter than the spindle 3*a* and is arranged concentrically and coaxially thereto so as to provide an intermediate annular space between the spindle 3*a* and the sleeve 14*a* for insertion of the clamping elements 33 which lie essentially in one axial plane, i.e. a plane extending through the axis of the spindle 3*a*. Each clamping element 33 is also free to swing or pivot for movement in the opening 28, i.e. between an extended position to secure the spool or bobbin sleeve carrier 31 to the chuck and a retracted position in which the spool or carrier 31 is released from the chuck.

By means of the thrust element 34 arranged to slide in the annular space between the spindle 3*a* and the mantle sleeve 14*a*, a pushing force is exerted on the thrust end 33.1 of the clamping element 33 in the axial direction of the chuck as illustrated by the arrow 34.1. As a result of this thrust or pushing movement 34.1, the clamping end 33.2 of the element 33 moves outwardly from the opening 28 due to the fact that the slide edge 33.3 connecting the thrust end 33.1 and clamping end 33.2 of the clamping element 33 slides along the opposing sliding surface 14.1 of the mantle sleeve 14*a* with a radially directed component of movement. Two forces are thus imposed on the clamping element 33 to achieve the desired extended clamping or gripping movement: first, the thrust force 34.1 at the thrust end 33.1, and second, the opposing force 34.2 against the slide edge 33.3 where it comes in sliding contact with the slanted surface 14.1 of the mantle 14*a*. These two forces 34.1 and 34.2 run axially parallel with reference to the chuck axis but in opposite directions and are spaced at a radial interval from each other; therefore, these two forces exert a torque or turning moment on the clamping element 33 in the axial plane as illustrated by the arrow 34.3. This torque rotates or pivots the clamping element 33 so that it is forced outwardly of the mantle sleeve 14*a* in a radial direction, thereby securely clamping or gripping the bobbin sleeve carrier 31.

The clamping movement of the element 33 imparted by the applied torque is equivalent to the forcing of a wedge between the spindle 3*a* and the bobbin tube or sleeve 31. The amount of the torque can be readily adjusted as in other embodiments of the invention so as to accommodate winding spools or bobbins of various sizes and weights, e.g. by selecting a suitable spring means or the like to exert the required force 34.1 against the thrust element 34.

In order to release each clamping position, it is necessary to exert a force in the direction of the arrow 34.4 by means of another thrust element (not shown) which counteracts and overbalances the preselected spring force or the like 34.1, causing the clamping element 33 to drop radially inwardly away from the inner surface of sleeve 31. This counteracting thrust element is preferably applied as indicated against the striking edge of the lug or cam ear 33.4, this striking edge lying approximately in a plane perpendicular to the spindle axis.

Instead of striking this lug 33.4 with a thrust element, it may also be connected by a lever arm to a piston actuated by pneumatic pressure or the like as in other embodiments of the invention. However, since a plurality of two or more clamping elements are often preferably arranged at the same axial position around the circumference of the spindle, the thrust element acting with the force 34.4 is most easily constructed as a ring projection on an annular piston head sliding in the space between the mantle sleeve 14*a* and the spindle 3*a*. Each lug 33.4 is thus contacted by such a ring projection at the same instant as the common piston is moved axially in the direction 34.4.

Figure 5:
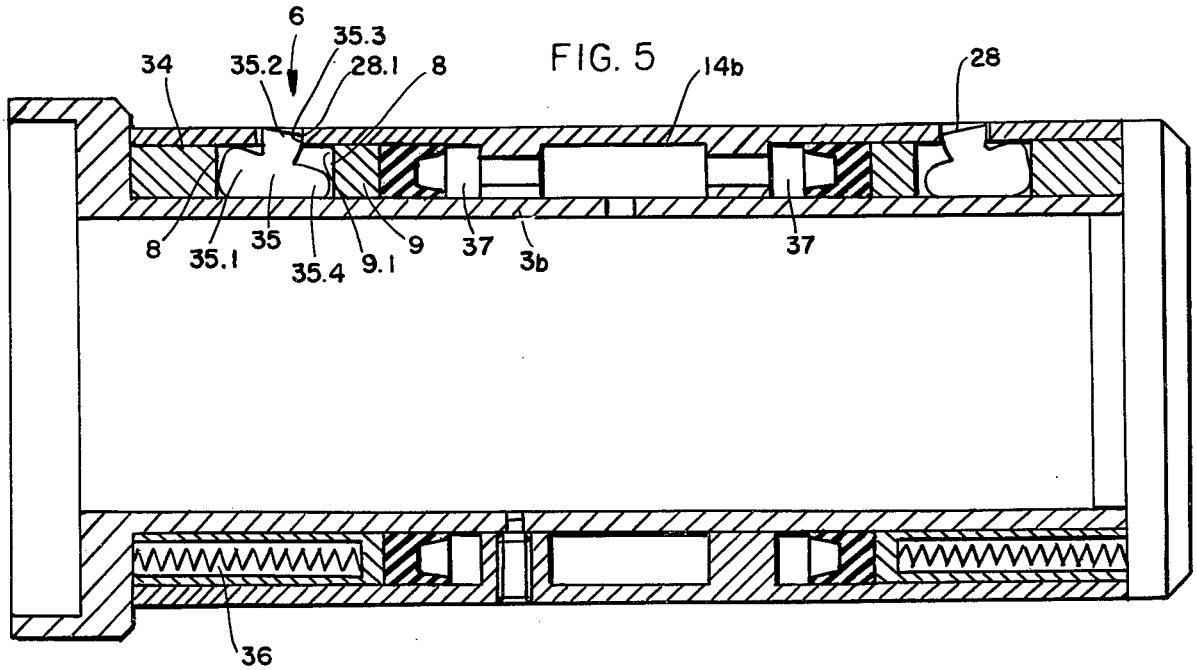
FIG. 5 is a schematic view in axial cross-section through a chucking spindle shaft of a still further embodiment of the invention.

In the further embodiment of the chucking spindle according to the invention illustrated in FIG. 5, a clamping element 35 is inserted in a manner similar to the embodiment of FIG. 4 into the intermediate annular space formed by the spindle 3*b* and the mantle sleeve 14*b*, thereby providing each of the clamping positions 6. Just as in the previously explained embodiments, the convexly arced or bowed slide cam edge 35.3 of the clamping element 35 is positioned in the mantle opening 28 for contact with the opposing sliding surface 28.1 of said opening, the clamping element in this case being shown in its retracted or non-clamping position. By means of the thrust force exerted in the axial direction by the thrust element 34 on the cammed thrust side 35.1 of the clamping element 35, the extendable gripping end 35.2 of the element 35 is moved radially outwardly of the opening 28 to come in gripping contact with a bobbin tube or sleeve (not shown) mounted about the mantle 14*b*. This axial movement of the thrust element 34 into the clamping or gripping position is effected by the spring force of the spring 36. By means of a peg-shaped enlargement of the clamping element 35, which forms the thrust end or side 35.1, the swinging or pivoting movement of the clamping element 35 in the intermediate space between the outer circumference of the spindle 3*b* and the inner circumference of the mantle sleeve 14*b* is accomplished substantially without any radial play.

On the side of its sliding edge 35.3, the clamping element 35 has a nose 35.4 adapted to be contacted and moved axially of the spindle by the ring piston 9 acting to release the clamping tension or force when the piston 9 moves to the left as shown in FIG. 5. The contacting surface 9.1 of ring piston 9 lies in the plane normal to the spindle axis, extending between the spindle 3*b* and the mantle 14*b*, and can be moved in direct opposition to the chuck engaging movement of the thrust element 34 by using a suitable force transmitting means. For example, a pneumatic ring piston and cylinder unit is preferably used to transmit force sufficient to counteract and overbalance the spring force of spring 36 in releasing each clamping element, i.e. to retract each element 35 to its release or non-clamping position. The front side of the ring piston 9, which fills the space between the spindle 3*b* and the mantle 14*b*, thus forms the release actuating surface 9.1.

For each clamping element 35, a cage 8 is formed consisting of the ring piston 9 and thrust element 34 as one piece such that its end faces or walls 8, facing the clamping element, form the boundaries of the cage.

Figure 6:
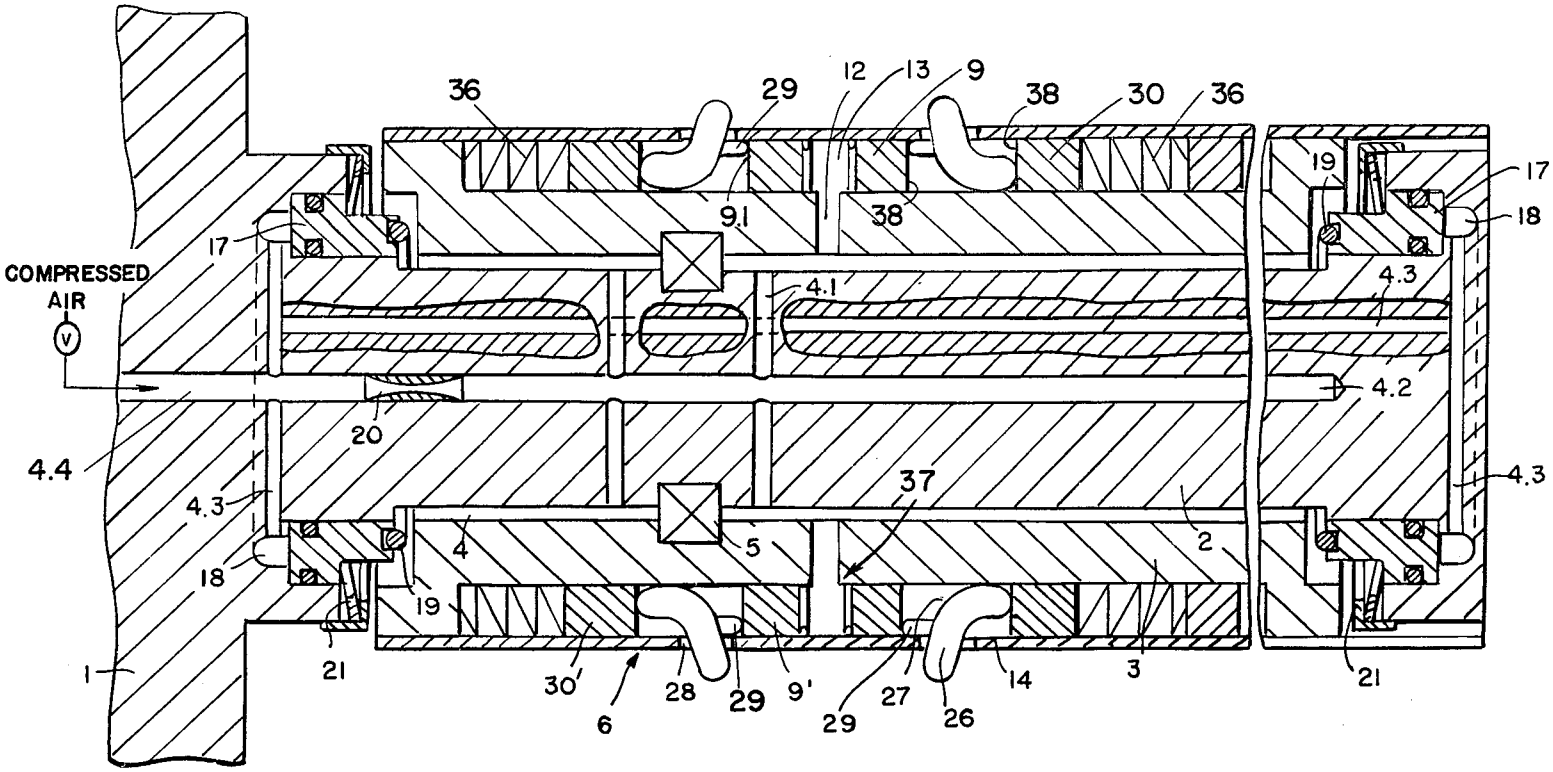
FIG. 6 is a schematic view in axial cross-section of yet another alternative embodiment of a chucking spindle arrangement, also taken through the spindle shaft with circumferential drive.

In the further embodiment of a chucking spindle arrangement according to FIG. 6 and similar to FIG. 1, specific clamping elements 26 are used which likewise are tensionable by a spring force and releasable or relaxable by pneumatic means. Here, the carrier arm 2 is fastened to project from the machine frame 1. On this carrier arm 2, the chucking spindle 3 is rotatably mounted by insertion of the bearing bodies 5, i.e. suitably positioned bearing elements on which the spindle 3 is supported for rotation. Between the carrier arm 2 and the spindle 3, an annular gap 4 is present (as in FIG. 1) and extends over most of the length of the spindle. This annular gap 4 is again connected over several radially arranged channels 4.1 with a distributor channel. It is also preferred in this embodiment to arrange the connecting channels before and after the bearing bodies 5, this arrangement preventing the lubricant of the bearings from being washed out by a one-sided air flow therethrough.

At several axially spaced positions along the circumference of the chucking spindle 3, the clamping spaces 6 are arranged with the specific clamping elements 26. These clamping elements may carry one or several bobbins or spools so that their number and arrangement are determined by the number and length of the bobbin carriers being inserted onto a chucking spindle.

Clamping elements 26 as shown in FIG. 6 are essentially kidney-shaped and present a sickle-shaped or convexly cammed sliding surface 27. These clamping elements lie with sliding surface 27 resting on the chucking spindle 3 and have their free ends projecting through the openings 28 formed in mantle sleeve 14. The other end of each clamping element 26 engages a spring-tensioned freely movable ring 30 which holds these elements in the clamping position shown in FIG. 6. Ring 30 is common to each of the clamping elements 26 at clamping places 6. The cage 38 is here formed by the ring 30 and the ring piston 9, between which the clamping elements 26 are arranged around the periphery of the spindle at one of the axial positions of a particular group of clamping places.

Under the thrust of the spring 36 acting through the ring thrust element 30 or 30', the clamping element would tend to be forced completely through the sleeve opening 28 except that the guide lug or lobe 29 is sufficiently extended beyond the sleeve opening to stop its radial passage.

The cylindrical ring piston 9 engages the cage 38 on one side so that each clamping element 26 is held in its clamping position. The ring piston 9 is loaded by a pressure medium from the annular gap 4 over the connecting channel 12 and over the cylinder space 13.

The cylinder space 13, which is used for driving or actuating the ring piston 9 and which cooperates with this piston 9 to form the piston-cylinder unit 37, is closed in radial direction by the mantle sleeve 14 which consists of individual segments whose total length corresponds to the spindle 3. In axial direction, the cylinder space 13 is preferably limited by another ring piston 9' such that at least two sets of clamping elements are acted upon by the same pressure-actuated system.

At the two ends of the chucking spindle 3, i.e. at one end attached to the machine and at the other free or projecting end, respectively, the annular space or gap 4 is capable of being closed or sealed off by additional ring pistons 17 which are movably arranged on the machine frame 1 or on the carrier arm 2. On the face of each ring piston 17, opposite the rotating spindle 3, an O-ring 19 is constructed as a sealing member which can be pushed by the piston 17 against the end of the spindle 3 and withdrawn again so as to close off or open up the annular space 4.

The annular cylinder spaces 18 associated with ring pistons 17 are supplied with a pressure medium over the bores 4.3 from a central supply channel 4.4. The fluid such as compressed air can be supplied through channel 4.4. as required by using any conventional control valve means. The pistons 17 are held in their initial open or retracted position by the individual plate springs 21, so that the pressure medium is free to escape from annular gap 4 and the remainder of the pressurized system. When compressed air or other pressurizing fluid is supplied through the supply channel 4.4, part of the pressurized stream is directed through the bores 4.3 into the cylinder spaces 18 to actuate pistons 17, thereby sealing off annular space 4 and permitting the other pressurized stream to act through the distributor channel 4.2. A choke 20 provides a transition point between the feed or supply channel 4.4. This operation of the pressure-actuated chucking spindle is essentially the same as described above in connection with FIGS. 1 and 2, but with the individual clamping elements having different constructions with different spring-tensioned and piston-actuated movements while otherwise retaining essentially the same clamping or gripping function.

A projection in the form of a lobe or lug member 29 is situated on the arcuately cammed slide surface 27. Over this lobe or lug 29, each clamping element 26 is in operable contact with its ring piston 9 or 9' for movement into a retracted or released position. This projection 29 essentially acts as a short lever arm which moves the clamping element 26 into a more retracted position when acted upon by the piston 9 or 9'. For example, annular piston 9' is designed to move between mantle sleeve 14 and chucking spindle 3. It also is common to all of the clamping elements of clamping places 6. The face of annular piston 9' away from lug 29 is held against axial movement beyond a desired point by a snap ring fitted in the chucking spindle 3 or mantle sleeve 14.

Similar to the embodiments described in reference to FIGS. 1 and 3, in order to retract clamping elements 26 so as to disengage the bobbin carrier (not shown), compressed air is conducted through feed channel 4.4, connector channel 4.1, annular gap 4 and bores 12 into cylinder space 13. In this manner, annular piston 9' is moved axially against lug 29 which forces the clamping elements 26 against the spring force of ring 30 in such a way that they slide on their sliding surface 27 on the circumference of chucking spindle 3. Therefore, due to this sliding movement, clamping elements 26 will more or less execute a rotary movement about their central axis so that their free end will be moved radially inward through mantle openings 28. In order to prevent clamping elements 26 from completely withdrawing in openings 28 and possibly becoming jammed therein, lug 29 is formed in such a manner that it will come to rest against the surface of chucking spindle 3 prior to this occurrence, thereby preventing the further withdrawal of the clamping elements 26. Through the cam-like turning movements of the clamping elements, the bobbin carrier will be released therefrom and can then be drawn off of the chucking spindle.

When the compressed air supply is disconnected from the arrangement, the spring 36 of ring 30 will again press the clamping elements 26 radially outward of clamping places 6. If no bobbin carrier happens to be placed over the chucking spindle at this point, lug 29 also serves to prevent the clamping elements from falling entirely through openings 28 and out of the chuck. Furthermore, in order to achieve a uniform outward movement of the clamping elements, it is desirable to distribute several engaging springs 36 about the circumference of each ring 30.

It is also possible to form ring 30 and piston 9 as one structural element in which an opening is made for the reception of the clamping elements 26. Such a construction is represented by the clamping elements shown on the right-hand side of FIG. 6. In this embodiment, the spring-tensioned ring 30 and annular piston 9 are combined to create a cage 38 for the reception of clamping elements 26, this cage simultaneously functioning as a thrust element for the actuating means. Radial openings or slots with the two end walls 38 extend through this one-piece ring piston from spindle 3 to sleeve 14 to receive the clamping elements 26. Hence, in this manner, the structural parts necessary for the operation of the clamping elements are reduced to a minimum.

While several particular embodiments of the present invention have been shown and described in detail, it should be understood that various obvious changes and modifications thereto may be made, and it is therefore intended in the following claims to include all such modifications and changes as may fall within the spirit and scope of this invention.

The invention is hereby claimed as follows:

1. In a clamping chuck on a thread-winding machine for the reception of a removable bobbin carrier wherein said chuck includes a chucking spindle turnably borne on an arm extending from the machine frame, a cylindrical mantle sleeve mounted concentrically about said spindle and having an inner diameter greater than an outer diameter of said spindle over a substantial portion of the total length of the chuck so as to define at least one annular cylindrical interspace between said sleeve and said spindle at a selected axial position along the chuck, and a plurality of clamping elements situated within said interspace and radially supported by the spindle with openings in said mantle sleeve for the radial passage therethrough of each clamping element, the improvement which comprises:

elongated clamping elements arranged in said interspace between said spindle and said mantle sleeve to swing freely in an axial plane of the chuck, each clamping element having an outer clamping end which is movable radially of its sleeve opening between an extended position for gripping the bobbin carrier and a retracted position for releasing the bobbin carrier, an inner thrust end free to slide while supported by the spindle and a force directing slide cam edge between said outer clamping end and said inner thrust end, said cam edge being in sliding contact along an opposing slide surface within the sleeve and spindle combination so as to provide a radially directed component of force;

means to exert two forces on each clamping element to cause a swinging movement into its extended clamping position, one force being applied in the area of said thrust end and the other force being applied in the area of the slide cam edge, each of said two forces being directed axially parallel of the chuck and opposite to one another and at a radially spaced distance from one another so that the two forces on the clamping element combine to exert a torque acting in the axial plane so as to swing the clamping element into its radially extended clamping position; and means to counteract said two forces to return each of said clamping elements to its retracted position.

2. A clamping chuck as claimed in claim 1 wherein said slide cam edge has a projecting lug or lobe arranged thereon for sliding contact with said opposing slide surface.

3. A clamping chuck as claimed in claim 2 wherein said opposing slide surface is movable to return the clamping element to its retracted position.

4. A clamping chuck as claimed in claims 1, 2 or 3 including a thrust element pressed in axial direction by a force transmitting means to act on the thrust end of said clamping element.

5. A clamping chuck as claimed in claim 3 including a thrust element pressed in axial direction by a resilient spring force acting on the thrust end of said clamping element to move it into the clamping position.

6. A clamping chuck as claimed in claim 5 wherein said opposing slide surface is pressed into the retracted position of the clamping element by an adjustable force transmitting means to counteract said spring force on said thrust element.

7. A clamping chuck as claimed in claim 6 wherein said force transmitting means to counteract said spring force is a pneumatic ring piston-cylinder unit.

8. A clamping chuck as claimed in claim 7 wherein said movable opposing slide surface is provided by the front face of the ring piston which is slidingly inserted in said annular interspace between the mantle sleeve and the spindle to form the pneumatic unit.

9. A chucking clamp as claimed in claim 8 wherein said slide surface and said thrust element are arranged on a ring piston fitted into said annular interspace and formed as one piece with radial openings extending therethrough to receive each clamping element such that one limiting end wall of said radial opening forms the thrust surface and the opposite limiting end wall of said radial opening forms the slide surface.

10. A chucking clamp as claimed in claim 9 wherein said one piece ring piston is pressed on the side of the thrust element by a resilient spring force to move the clamping element into its clamping position and is pressed on the side of the slide surface by pneumatic pressure introduced into the annular cylindical interspace between the spindle and mantle sleeve to move the clamping element into its retracted position.

11. A clamping chuck as claimed in claim 2, 6 or 10 wherein each clamping element is formed in a kidney shape having a convex side as the cam edge with said lug or lobe thereon.

12. A clamping chuck as claimed in claim 2, 6 or 10 wherein said projecting lug or lobe extends sufficiently beyond the opening in the mantle sleeve to stop the clamping element in its radial passage through said opening.

13. A clamping chuck as claimed in claim 1 wherein said opposing slide surface is formed by one side of the opening of the mantle sleeve which contacts the slide cam edge of said clamping element as it lies on the edge of the sleeve opening, and wherein a thrust element exerting a thrust force to swing the clamping element into its clamping position is axially movable with reference to the chuck so that the clamping element is urged radially outwardly of the sleeve opening.

14. A clamping chuck as claimed in claim 13 wherein the slide cam edge of the clamping element is in the form of a convex arc.

15. A clamping chuck as claimed in claim 13 wherein the thrust element is pressed into the clamping position by a resilient spring force.

16. A clamping chuck as claimed in claim 13 wherein the thrust end of the clamping element as seen in its swinging plane is thickened with a peg shape in such a manner that the positioning of the clamping element between the outer circumference of the spindle and the inner circumference of the mantle sleeve as well as its swinging movement imparted by the thrust element can be accomplished essentially without radial play.

17. A clamping chuck as claimed in claim 13 wherein said clamping element has a nose at the lower end of its sliding cam edge, said nose being arranged for contact with a tension releasing surface which is movable in axial direction and which is carried between said mantle sleeve and said spindle in a plane perpendicular to the chuck axis, and said tension releasing surface being engaged for movement in its axial direction by said means to counteract the two torque producing forces, thereby returning the clamping element to its retracted position.

18. A clamping chuck as claimed in claim 17 wherein said means to counteract the torque producing forces includes a force transmitting pneumatic ring piston and cylinder unit.

19. A clamping chuck as claimed in claim 18 wherein said tension releasing surface is the front face of said ring piston which occupies an axial segment of the interspace between the spindle and the mantle sleeve.

20. A clamping chuck as claimed in claim 19 wherein the ring piston and the thrust element consist of one piece and form the facing end walls of a cage operatively containing each clamping element.

21. A clamping chuck as claimed in claim 20 wherein the cage is pressed on one side by a resilient spring force for movement into its clamping position and is pressed on the other side by pneumatic means into its retracted position for release of the bobbin carrier.

22. A clamping chuck as claimed in claim 1, 2 or 13 wherein said means to counteract the two torque producing forces comprises a pressure regulatable, pneumatic ring piston and cylinder unit including at least one annular piston ring which is slidably mounted on and about said spindle for rotation therewith, a cylinder space arranged behind said annular piston ring with means to force compressed air as required into said cylinder space in order to actuate said piston ring for the return of clamping elements to their retracted position, said cylinder space being an encloseable annular interspace between the spindle and the mantle sleeve and said cylinder space being connected to a compressed air feed channel leading from the machine frame into a hollow space in the spindle by means of bores formed in the spindle, and closure means to seal off said cylinder space simultaneously with the feed of compressed air thereto.

* * * * *